United States Patent [19]

Zegers

[11] Patent Number: 4,988,915

[45] Date of Patent: Jan. 29, 1991

[54] PICTURE DISPLAY DEVICE

[75] Inventor: Antonius P. F. Zegers, Eindhoven, Netherlands

[73] Assignee: U.S. Philips Corporation, New York, N.Y.

[21] Appl. No.: 815,297

[22] Filed: Dec. 27, 1985

Related U.S. Application Data

[63] Continuation of Ser. No. 75,775, Sep. 17, 1979, abandoned, which is a continuation of Ser. No. 872,098, Jan. 25, 1978, abandoned.

[30] Foreign Application Priority Data

Feb. 8, 1977 [NL] Netherlands ..... 7701287

[51] Int. Cl.[5] ..... H01J 29/88

[52] U.S. Cl. ..... 313/479; 313/450; 313/440

[58] Field of Search ..... 313/440, 450, 479, 477 HC

[56] References Cited

U.S. PATENT DOCUMENTS

| | | | |
|---|---|---|---|
| 2,508,001 | 5/1950 | Swedlund | 313/479 X |
| 2,602,902 | 7/1952 | Haugen | 335/212 |
| 3,355,617 | 11/1967 | Schwartz et al. | 313/450 |
| 3,746,904 | 7/1973 | Torre | 313/479 |
| 3,979,633 | 9/1976 | Davis et al. | 313/450 |
| 3,996,491 | 12/1976 | Larson et al. | 313/479 |
| 4,018,717 | 4/1977 | Francel et al. | 313/479 |
| 4,217,521 | 8/1980 | Dietch et al. | 313/479 |

OTHER PUBLICATIONS

Standard Handbook for Electrical Engineers, edited by Knowlton, p. 341 (1957).

*Primary Examiner*—Kenneth Wieder
*Attorney, Agent, or Firm*—Robert J. Kraus

[57] ABSTRACT

A color display tube is provided with a high resistance layer having a resistance between $10^6$ and $10^{10}$ ohms per square on the external portion of the tube envelope underneath the deflection coil system. The high resistance layer prevents arcing between the coil system and the envelope without adversely affecting the deflection field.

18 Claims, 1 Drawing Sheet

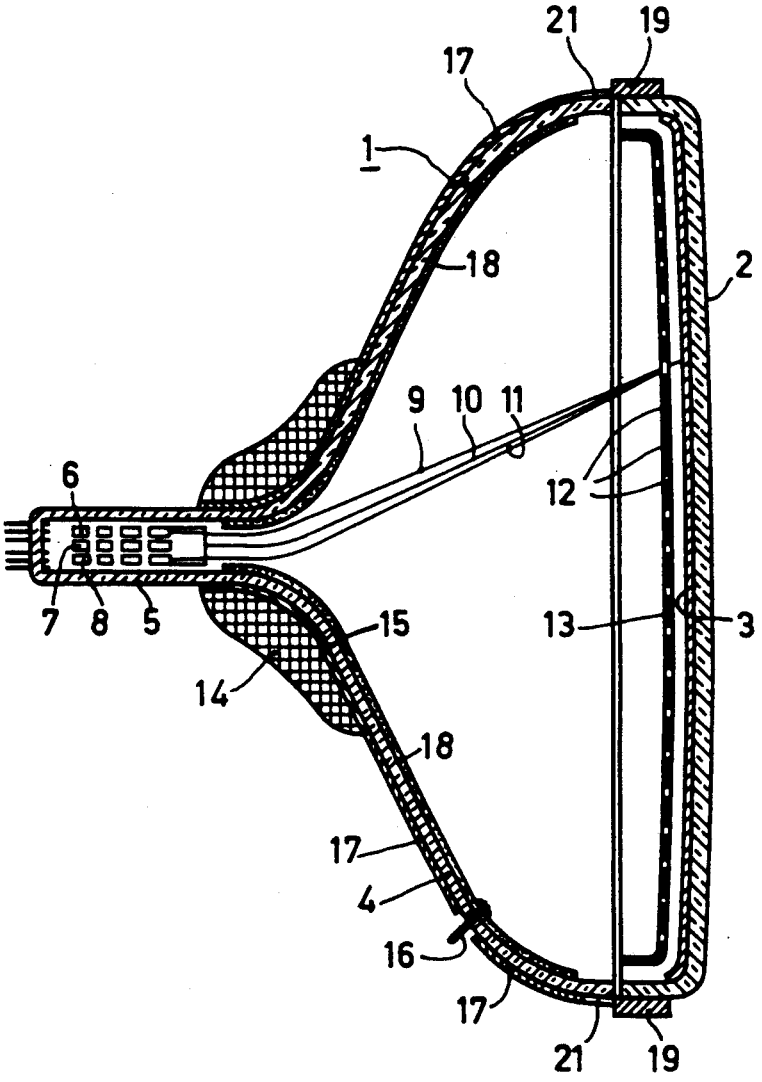
21
19
17
1
18
2
9
10
11
6
12
7
8
5
15
13
3
14
18
17
4
16
17
21
19

PICTURE DISPLAY DEVICE

This is a continuation of application Ser. No. 075,775, filed 17 Sept. 1979, now abandoned, which is a continuation of application Ser. No. 872,098, filed: 25 Jan. 1978, now abandoned.

The invention relates to a picture display device having a display tube for displaying coloured pictures, comprising, in an evacuated envelope, means for generating one or more electron beams. The envelope includes a display window provided with a display screen on its inner surface, a cone and a neck. The inner surface of the cone is covered with a conductive layer and the outer surface of the cone is partly covered with a low-resistance layer. The display device further comprises a system of deflection coils provided around the neck-cone transition portion of the envelope.

The invention also relates to a display tube for such a device.

It is known from U.S. Pat. No. 3,621,318 to provide, in a colour display tube of the shadow mask type, a conductive layer on the inside and the outside surfaces of the cone of the envelope. The conductive layer on the inside of the cone forms the connection between the last electrode of the electron gun and the display screen on which the electron beams are incident. The conductive layer on the inside of the conical portion of the envelope thus acts as second anode and also creates a field-free space in the region of the display tube in which the electron beams are not deflected. The conductive layer on the outside of the cone is grounded and together with the internal conductive layer forms a capacitor which serves to smooth the applied high voltage.

A similar device having a display tube is known from Swiss Patent Specification No. 309,701, in which the conductive layer provided on the outside of the cone extends to below the system of deflection coils. In order to reduce interference radiation generated by the system of deflection coils by electrostatic screening, a resistive layer having a low resistance was used below the system of deflection coils so that the attenuation of the deflection fields generated by the system was less than 5%. In colour display tubes this limit of 5% is in many cases still much too high. There should rather be no attenuation at all of the deflection fields of such a colour display tube. Moreover, in colour display tubes the voltage difference between the deflection coils and the underlying layer is approximately 1.2 KV so that a low-resistance layer below the system of deflection coils presents insulation problems and gives rise to flashovers between such a layer and the system of deflection coils.

If in picture display devices of the kind mentioned in the first paragraph, the low-resistance layer below the system of deflection coils is omitted, difficulties also occur. The first difficulty is generation of interference radiation. However, this can be suppressed in another manner. The second difficulty is the following. Since the base portions of the envelope are coupled statically to the layer on the inside of the cone which is at a high voltage the bare or uncoated portions, obtain an influential or inductive charge. As a result, an annoying sputtering noise sometimes occurs during operation of the picture display device. The noise is caused by flash-over of the influential charge from the bare, charged envelope portions to the system of deflection coils or the low-resistance outer coating on the cone. This occurs, in particular, in the case of frame changes in which the anode current varies strongly resulting in variations of 2 to 3 KV in the anode voltage.

It is the object of the invention to provide a picture display device having a display tube for displaying coloured pictures, in which the occurrence of influential charges and the resulting flashovers are suppressed with substantially no attenuation of the deflection fields of deflection coil system.

In the picture display device according to the invention, at least the region of the envelope underneath the system of deflection coils is covered with a very high-resistance layer having a resistance of between $10^6$ and $10^{10}$ ohms per square. The high-resistance layer is connected electrically to the low-resistance layer on the outside of the cone.

Such a very high-resistance layer has such good insulation properties with respect to the deflection coil system that flashovers no longer occur. The conductive properties, however, are still sufficient to dissipate the influential charge to the low-resistance layer.

In addition, for reasons of safety, a strip-shaped region between the reinforcement band and the low-resistance outer coating which is at the line voltage is often left uncovered. This strip-shaped region thus also obtains an influential charge so that flashovers to the reinforcement band and the low-resistance layer occur. The flashovers can also be suppressed by separating the reinforcement band from the low-resistance layer by a strip-shaped region which is also at least partly covered with a very high-resistance layer. The high-resistance layer has a resistance of between 10 and $10^{10}$ ohms per square and is connected electrically to the low-resistance layer.

The resistance of the very high-resistance layer is preferably between $10^8$ and $10^9$ ohms per square.

In order to ensure a good electrical connection between the high-resistance and low-resistance layers, the layers overlap each other preferably by at least 1 cm.

The invention will now be described by way of example with reference to the drawing, in which the single figure diagrammatically shows a device for displaying colour television pictures.

The glass envelope 1 of the tube includes a display window 2 provided with a display screen 3 on its inner surface, a cone 4 and a neck 5. The display screen 3 in most colour television display tubes consists of a very large number of triplets of phosphor lines or dots. Three electron guns 6, 7 and 8 are provided mounted in the neck 5. The electron beams 9, 10 and 11 generated by the electron guns pass through apertures 12 in the shadow mask 13 in a manner such that each electron beam 9, 10 and 11 impinges upon a phosphor region of a different colour. The three electron beams are deflected simultaneously in the direction of the frame and line deflection by the system of deflection coils 14 disposed about the neck 5 and the narrow end of the cone 4. According to the invention, a high-resistance layer 15 having a resistance of $5.10^8$ ohms per square is provided underneath the system of the deflection coils 14. The remainder of the cone with the exception of, a region around the anode contact 16, is covered with a low-resistance layer 17 having a resistance of approximately 10 ohms per square. The inside of the cone is covered with a conductive coating 18 having a resistance of approximately 25 ohm per square. A metal tensioning or reinforcement band 19 is usually provided around the display window 2. The low-resistance outer coating of the cone is usually at the line voltage. For safety reasons the reinforcement band 19 should not be at the line voltage and therefore, a strip-shaped region of the outer cone surface between the reinforcement band 19 and the low-resistance layer 17 is usually not covered with a layer. As a result an influential charge will also occur on the uncoated region because the conductive coating on the inside of the cone has a high potential. According to the invention, this region is preferably also covered with a high-resistance layer 21 having a resistance of approximately $5\times10^8$ ohms per square, so as to prevent charging of the glass surface and breakdown between the reinforcement band 19 and the low-resistance layer.

The high-resistance layer may be made from metal oxides, for example ferrites, tin oxide, vanadium oxide, chromium oxide, manganese oxide and iron oxide. Lead sulphide and soots or mixtures of all these substances may also be used.

A layer 25 μm thick, provided by spraying, brushing or dipping and comprising approximately 40% by weight of polyvinyl acetate and 60% by weight of zinc manganese ferrite, has a resistance of $10^9$ to $10^{10}$ ohms per square. Other resistance values can be adjusted by varying the ratio of polyvinyl acetate and ferrite.

What is claimed is:

1. An apparatus for displaying pictures comprising a colour display tube including an evacuated envelope having a display window provided with a display screen on its inner surface, a cone and a neck, means mounted in said envelope for generating at least one electron beam directed onto said display screen, and deflection means mounted on said envelope for deflecting said electron beam across said screen, said envelope further including a conductive layer on the internal surface of said cone, a low resistance layer on a portion of the external surface of said cone, and a high resistance layer having a resistance between $10^6$ and $10^{10}$ ohms per square disposed underneath said deflection means on the external surface of said envelope, said high resistance layer being electrically connected to said low resistance layer.

2. The apparatus according to claim 1 including a reinforcement band disposed about said envelope and being separated from said low resistance layer by a second high resistance layer applied on and extending at least partly about the external surface of said envelope, said second layer being electrically connected to said low resistance layer.

3. The apparatus according to claim 1 wherein the resistance of said high resistance layer is between $10^8$ and $10^9$ ohms per square.

4. An apparatus according to claim 1 wherein said high resistance layer overlaps said low resistance layer by at least one centimeter.

5. A display tube comprising an envelope having a neck and a cone, and including a low resistance layer on a portion of the external surface of said cone and a high resistance layer having a resistance between $10^6$ and $10^{10}$ ohms per square on the external surface portion of said envelope forming a transition between said neck and said cone where a deflection coil system is to be mounted, said high resistance layer being electrically connected to said low resistance layer, said display tube further including a reinforcement band disposed about said envelope and separated from said low resistance layer by a second, strip-shaped high resistance layer applied to the external surface of an extending at least partly about said envelope between said low resistance layer and said reinforcement band, said second layer having a resistance of between $10^6$ and $10^{10}$ ohms per square and being electrically connected to said low resistance layer.

6. A display tube comprising an envelope having a neck and a cone, and including a low resistance layer on a portion of the external surface of said cone and a high resistance layer having a resistance between $10^6$ and $10^{10}$ ohms per square on the external surface portion of said envelope forming a transition between said neck and said cone where a deflection coil system is to be mounted, said high resistance layer being electrically connected to said low resistance layer, being approximately 25 μm thick and comprising approximately 40% by weight of polyvinyl acetate and 60% by weight of zinc-manganese ferrite.

7. An apparatus for displaying pictures comprising a colour display tube including an evacuated envelope having a display window provided with a display screen on its inner surface, a cone and a neck, means mounted in said envelope for generating at least one electron beam directed onto said display screen, and deflection means mounted on said envelope for deflecting said electron beam across said screen, said envelope further including a conductive layer on the internal surface of said cone, a low resistance layer on a portion of the external surface of said cone, and a high resistance layer having a resistance between $10^6$ and $10^{10}$ ohms per square disposed underneath said deflection means on the external surface of said envelope, said high resistance layer overlapping said low resistance layer by at least one centimeter to thereby electrically connect said high resistance layer to said low resistance layer.

8. A display tube comprising an envelope having a neck and a cone, a low resistance layer on a portion of the external surface of said cone and a high resistance layer having a resistance between $10^6$ and $10^{10}$ ohms per square and a thickness of approximately 25 μm on the external surface portion of said envelope forming a transition between said neck and said cone where a deflection coil system is to be mounted, said high resistance layer comprising approximately 40% by weight of polyvinyl acetate and 60% by weight of zinc-manganese ferrite, said high resistance layer being electrically connected to said low resistance layer.

9. In a color television tube having a glass envelope with a display window, a neck, a cone, an internal screen on said display window, electron gun means within said neck for directing an electron beam to said screen, and a conductive layer inside said cone and the adjacent portions of said neck, said neck being adapted to be received in a deflection yoke; the improvement comprising:

(a) a high resistance coating on the outer surface of said envelope adapted to underly said yoke, said high resistance coating having a resistivity of from $10^6$ to $10^{10}$ ohms per square;

(b) a low resistance coating on the outer surface of said cone adjoining and electrically connected to said high resistance coating; and (c) a conductive band on said envelope adjacent the juncture of said cone and display window, said low resistance layer being separated from said band by a strip of a second high resistance coating having a resistivity from $10^6$ to $10^{10}$ ohms per square, said second high resistance coating being electrically connected to said band and to said low resistance coating.

10. An apparatus for displaying pictures comprising a color display tube including an evacuated envelope having a display window provided with a display screen on its inner surface, a cone and a neck, means mounted in said envelope for generating at least one electron beam directed onto said display screen, and deflection means mounted on said envelope for deflecting said electron beam across said screen, said envelope further including a conductive layer on the internal surface of said cone, a low resistance layer on a portion of the external surface of said cone, a first high resistance layer having a resistance between $10^6$ and $10^{10}$ ohms per square disposed underneath said deflection means on the external surface of said envelope, and a second high resistance layer having a resistance between $10^6$ and $10^{10}$ ohms per square extending at least partly around this external surface of the envelope adjacent a juncture of the cone and the display window, said first and second high resistance layers being electrically connected to said low resistance layer.

11. An apparatus for displaying pictures comprising a color display tube including an evacuated envelope having a display window provided with a display screen on its inner surface, a cone and a neck, means mounted in said envelope for generating at least one electron beam directed onto said display screen, and deflection means mounted on said envelope for deflecting said electron beam across said screen, said envelope further including a conductive layer on the internal surface of said cone, a low resistance layer on a portion of the external surface of said cone, and a first high resistance layer having a resistance between $10^6$ and $10^{10}$ ohms per square disposed underneath said deflection means on the external surface of said envelope, said high resistance layer being electrically connected to said low resistance layer, a reinforcement band disposed about said envelope and separated from said low resistance layer by a second high resistance layer applied on and extending at least partly about the external surface of said envelope, said second layer being electrically connected to said low resistance layer.

12. An apparatus as in claim 11, where the resistance of the first high resistance layer is between $10^8$ and $10^9$ ohms per square.

13. An apparatus as in claim 11 where the first high resistance layer overlaps the low resistance layer by at least one centimeter.

14. A display tube comprising an envelope having a neck and a cone, and including a low resistance layer on a portion of the external surface of said cone and a high resistance layer having a first resistance between $10^6$ and $10^{10}$ ohms per square on the external surface portion of said envelope forming a transition between said neck and said cone where a deflection coil system is to be mounted, said high resistance layer being electrically connected to said low resistance layer, said display tube including a reinforcement band disposed about said envelope and separated from said low resistance layer by a second, strip-shaped high resistance layer applied to the external surface of and extending at least partly about said envelope between said low resistance layer and said reinforcement band, said second layer having a resistance of between $10^6$ and $10^{10}$ ohms per square and being electrically connected to said low resistance layer.

15. A display tube as in claim 14 where the resistance of the first high resistance layer is between $10^8$ and $10^9$ ohms per square.

16. A display tube as in claim 14 where the first high resistance layer overlaps the low resistance layer by at least one centimeter.

17. A display tube comprising an envelope having a neck and a cone, and including a low resistance layer on a portion of the external surface of said cone and a high resistance layer having a resistance between $10^6$ and $10^{10}$ ohms per square on the external surface portion of said envelope forming a transition between said neck and said cone where a deflection coil system is to be mounted, said high resistance layer being electrically connected to said low resistance layer, having a thickness of approximately $25_{um}$, and comprising approximately 40% by weight of polyvinyl acetate and 60% by weight of zinc-manganese ferrite.

18. In a color television tube having a glass envelope with a display window, a neck a cone, an internal screen on said display window, electron gun means within said neck for directing an electron beam to said screen, and a conductive layer inside said cone and the adjacent portions of said neck, said neck being adapted to be received in a deflection yoke; the improvement comprising a high resistance coating on the outer surface of said envelope adapted to underly said yoke, said high resistance coating having a resistivity of from $10^6$ to $10^{10}$ ohms per square, a low resistance coating on the outer surface of said cone adjoining and electrically connected to said high resistance coating, a conductive band on said envelope adjacent the juncture of said cone and display window, said low resistance layer being separated from said band by a strip of a second high resistance coating having a resistivity from $10^6$ to $10^{10}$ ohms per square, said second high resistance coating being electrically connected to said band and to said low resistance coating.

* * * * *